US005499772A

United States Patent [19]

Maeda et al.

[11] Patent Number: 5,499,772

[45] Date of Patent: Mar. 19, 1996

[54] WINDING OPERATION CONTROL METHOD AND APPARATUS FOR AUTOMATIC WINDER

[75] Inventors: Yoshiyasu Maeda, Yamatokouriyama; Norio Kubota, Kyoto, both of Japan

[73] Assignee: Murata Kikai Kabushiki Kaisha, Kyoto, Japan

[21] Appl. No.: 133,867

[22] Filed: Oct. 12, 1993

[30] Foreign Application Priority Data

Oct. 16, 1992 [JP] Japan ..... 4-278978
Feb. 25, 1993 [JP] Japan ..... 5-063424

[51] Int. Cl.[6] ..... B65H 54/02; B65H 59/12

[52] U.S. Cl. ..... 242/35.5 R; 242/154; 242/18 R

[58] Field of Search ..... 242/35.5 R, 32, 242/154, 419.7, 18 R

[56] References Cited

U.S. PATENT DOCUMENTS 3,062,480 11/1962 Suggs ..... 242/154
4,245,794 1/1981 Hasegawa et al. ..... 242/35.5 R X
4,880,175 11/1989 Yamauchi et al. ..... 242/35.5 R X
4,961,546 10/1990 Ryer, II et al. ..... 242/154
5,056,734 10/1991 Uchida et al. ..... 242/154 X
5,377,923 1/1995 Matsui et al. ..... 242/18 R X

*Primary Examiner*—Daniel P. Stodola
*Assistant Examiner*—Michael R. Mansen
*Attorney, Agent, or Firm*—Armstrong, Westerman, Hattori, McLeland & Naughton

[57] ABSTRACT

A yarn tension control device of an automatic winder which includes a variably controlled tensioning device for each of a multitude of spindles of a winding unit; a tension detecting device for specific one of the multitude of spindles; and control devices for controlling the tensioning device for the specific spindle by the tension detecting device and for controlling the tensioning device for other multitude of spindles on the basis of an output value to the tensioning device for this specific spindle.

10 Claims, 6 Drawing Sheets

WINDING OPERATION CONTROL METHOD AND APPARATUS FOR AUTOMATIC WINDER

BACKGROUND OF THE INVENTION

1. Field of the Invention

The present invention relates to a winding operation control method and apparatus for an automatic winder provided with rows of a multitude of spindles of a winding unit for taking up the yarn to produce a package.

2. Prior Art

A yarn supply bobbin produced at a fine spinning frame such as a ring spinning frame is supplied to an automatic winder of the following process, where the yarn is unwound, being taken up onto a package to a specific amount of yarn and a specific shape while yarn faults are removed. Usually several to scores of yarn supply bobbins are used to produce one package. In this automatic winder winding units having a multitude of spindles are arranged in parallel. Hereinafter the arrangement of one winding unit U will be explained by referring to FIG. 5.

In FIG. 5, the yarn Y unwound from a yarn supply bobbin 1 flows through a balloon breaker 2, an optical feeler 3 for detecting the presence or absence of the yarn Y, a disc-type tensioning device 5 for manual adjustment, and a yarn fault detecting head for checking and cutting off a yarn fault at a clearer 6, being taken up onto a package P rotating on a traverse drum 7. This package P is rotatably supported on a cradle 9 at both ends of its taken-up tube 8. Provided on the large-diameter side of the cradle 9 is a friction roller 10 which is slightly larger in diameter than the large-diameter end of the take-up tube 8; at the initial period of winding on the package P the friction roller 10 and the drum 7 rotate in contact with each other, taking up the yarn Y.

A yarn signal from the clearer 6 is inputted into a unit controller 11. The unit controller 11 is designed to cut off and remove a faulty yarn by the cutter built in the clearer 6 upon finding out the faulty yarn such as a slub, thick yarn and thin yarn. Thereafter, the suction mouth 13 is rotated to the package P side and at the same time the drum 7 is rotated reversely to catch the upper yarn, then rotating the suction mouth 13 downwardly in the drawing to guide the upper yarn to the yarn joining device 15. Also an intermediate joining pipe 14 is rotated to the vicinity of the feeler 3 to catch the lower yarn running to the feeler 3; then the intermediate joining pipe 14 is rotated upwardly in the drawing to guide the lower yarn to the yarn joining device 15. Then, after the upper and lower yarns are joined at the yarn joining device 15, the drum 7 is rotated to restart winding.

A motor 16 which drives the drum 7 is controlled by the unit controller 11. The rotation of the drum 7 is detected by a drum rotation sensor 17, which produces pulse signals which are counted and integrated by the unit controller 11. An integrated value thus gained is compared with a set value by a control device 18 which controls the winding unit U of a multitude of spindles. When the package has been wound to a specific yarn length, the drum 7 is stopped and the green lamp 19 is turned on, indicating that the bobbins are waiting for doffing by a doffing device.

The feeler 3 functions to detect the absence of the yarn, outputting a no-yarn signal to the unit controller 11. When the bobbin 1 has been fully unwound, the feeler 3 outputs the no-yarn signal and at the same time the clearer 6 which detects a yarn defect stops outputting a yarn signal. With the detection of the empty bobbin, the unit controller 11 outputs a "bobbin change" command; the empty bobbin is thus discharged and a new bobbin 1 is fed to the winding position. The yarn end found out from the new bobbin 1 is blown upwardly to the vicinity of the feeler 3, being joined at the yarn joining device 15 by the operation of the above-described suction mouth 13 and the intermediate joining pipe 14. Subsequently the unwinding of the bobbin 1 is started.

In each winding unit, usually several to several tens of supply bobbins 1 are joined while being removed of their yarn defects, forming one full package. Production performance of this winding unit U largely depends upon the winding speed, but the practical winding speed of a prior-art winding unit U was around 1000 m/min. because the unwinding tension increased with an increase in the winding speed. Particularly from the time when the bobbin has been unwound 70 percent, that is, when about 30 percent of yarn remains on the bobbin, the mean angle of separation of a yarn from the yarn layer of the bobbin 1 decreases, resulting in friction between yarns or friction between the yarn and the take-up tube and sudden increase in the unwinding tension which causes the occurrence of yarn breakage due to the tension.

In an attempt to prevent such an increase in the unwinding tension, there has been proposed such an automatic winder that can offset an increase in the unwinding tension of the yarn by supervising the unwinding tension by the yarn tension detecting device and by gradually reducing the yarn tension being added by the tensioning device which is adjustable.

However, the winding unit U is provided with equipment along the yarn path and there exists almost no excess space for newly setting up a yarn tension detecting device. Besides, the tension detecting device is comparatively expensive and therefore it is impossible to set it for every winding unit U. It is, therefore, considered to output a desired tension pattern to the variably controllable tensioning device 5 of each winding unit U from the control device which controls the winding unit U, without providing the tension detecting device. However, there exists such a problem that since the tension adjusting effect of the tensioning device varies with the type of yarn to be handled, it is unknown whether the yarn tension is gradually decreased for the purpose of actually offsetting an increased unwinding tension when a tension pattern one-sidely set by the control device 18 is used.

In view of the above-described problems, the present invention has been accomplished and has an object to provide a tension control device of an automatic winder capable of increasing and decreasing the yarn tension to a desired value without using a tension detecting device at each winding unit.

SUMMARY OF THE INVENTION

To accomplish the above-mentioned object, a tension control device of an automatic winder according to the present invention is equipped with a variably controllable tensioning device for each of a multitude of spindles of a winding unit; a yarn tension detecting device for specific one of the multitude of spindles; this yarn tension detecting device serving to control the yarn tensioning device for the specific spindles; and a control device for controlling the yarn tensioning device for a multitude of other spindles on the basis of an output value of the tensioning device for the specific spindles.

The winding unit functions commonly to unwind yarn-supply bobbins of the same type of yarn by all or a group of many spindles; therefore the yarn tension detecting device is provided for specific one of the multitude of spindles; the specific spindles are controlled to gain a desired yarn tension; and furthermore the tensioning device for a multitude of other spindles is controlled on the basis of output to the tensioning device for the specific spindles, thus obtaining a desired tension pattern for the multitude of other spindles as the specific spindles.

BRIEF DESCRIPTION OF THE DRAWINGS

FIG. 3(*a*) shows the combs of the tension detecting device, shown in FIG. 3, being engaged;

DETAILED DESCRIPTION OF PREFERRED EMBODIMENT

Figure 1:
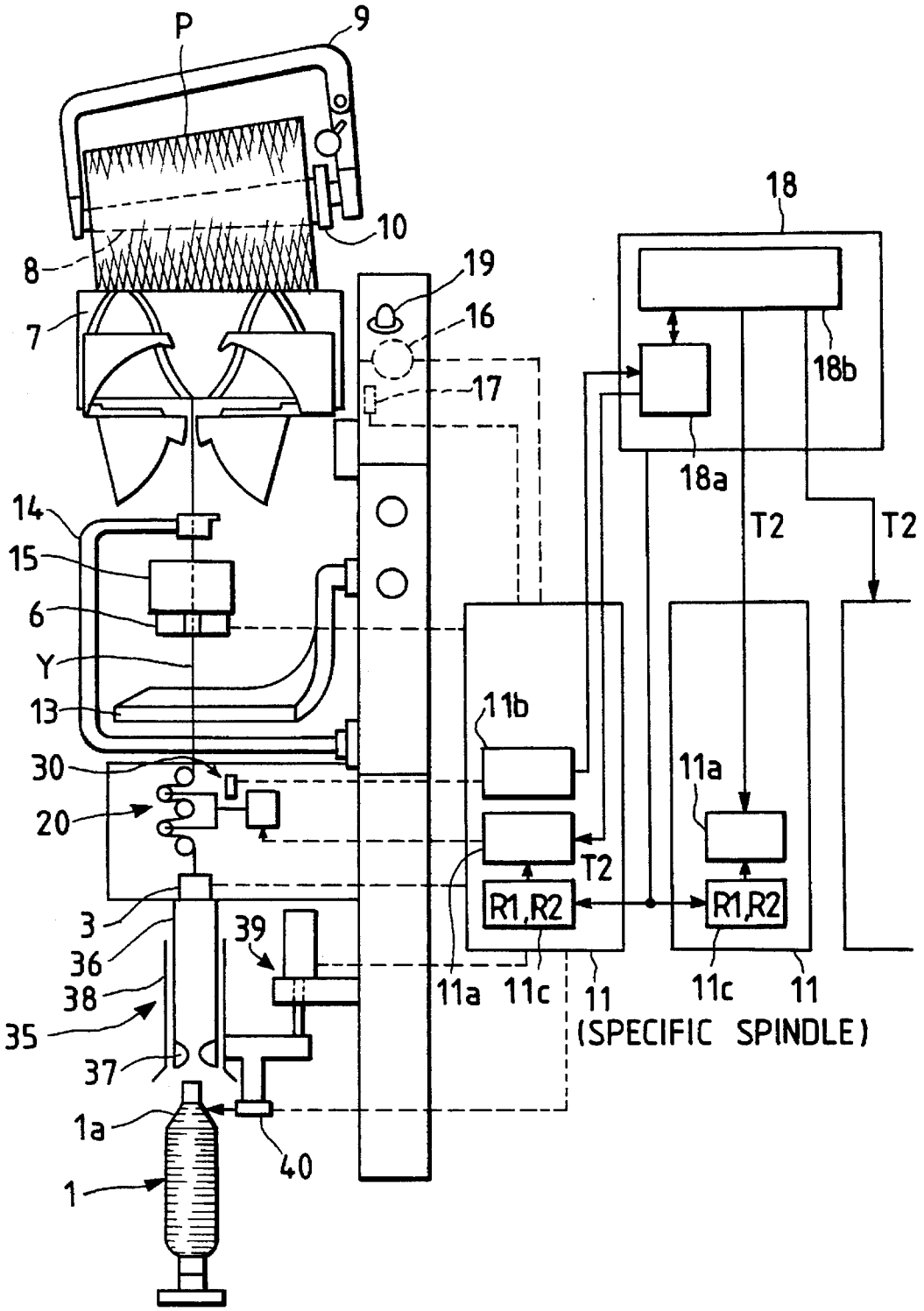
FIG. 1 is a schematic block diagram of an automatic winder using a yarn tension control device of the present invention.
Figure 2:
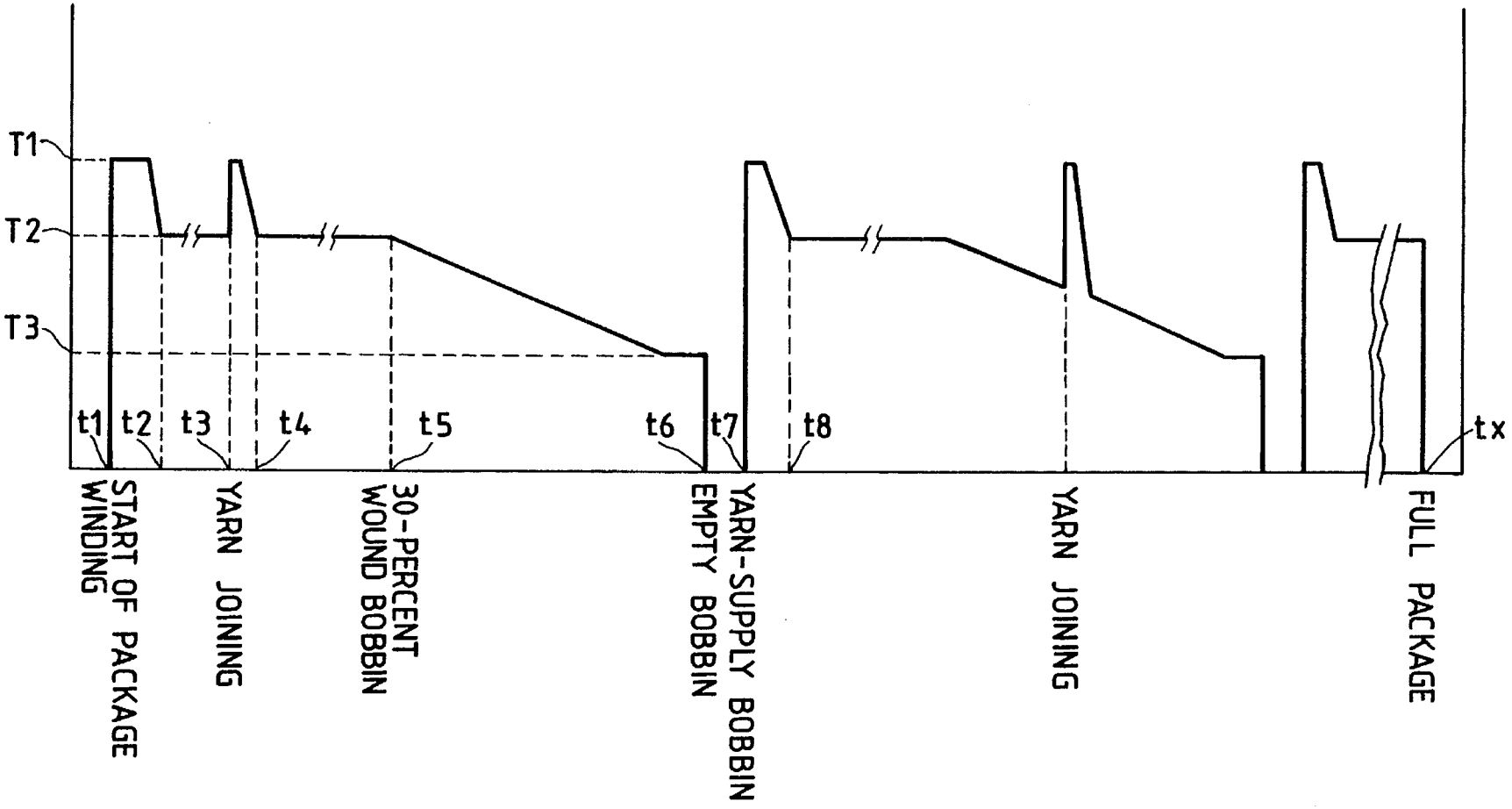
FIG. 2 is a graph showing set values for the tensioning device.

Hereinafter an exemplary embodiment of a yarn tension control device of an automatic winder according to the present invention will be explained on the basis of the accompanying drawings. FIG. 1 is a schematic block diagram of the automatic winder to which the yarn tension control device of the present invention is applied, and FIG. 2 is a graph showing set values for the yarn tensioning device.

Figure 5:
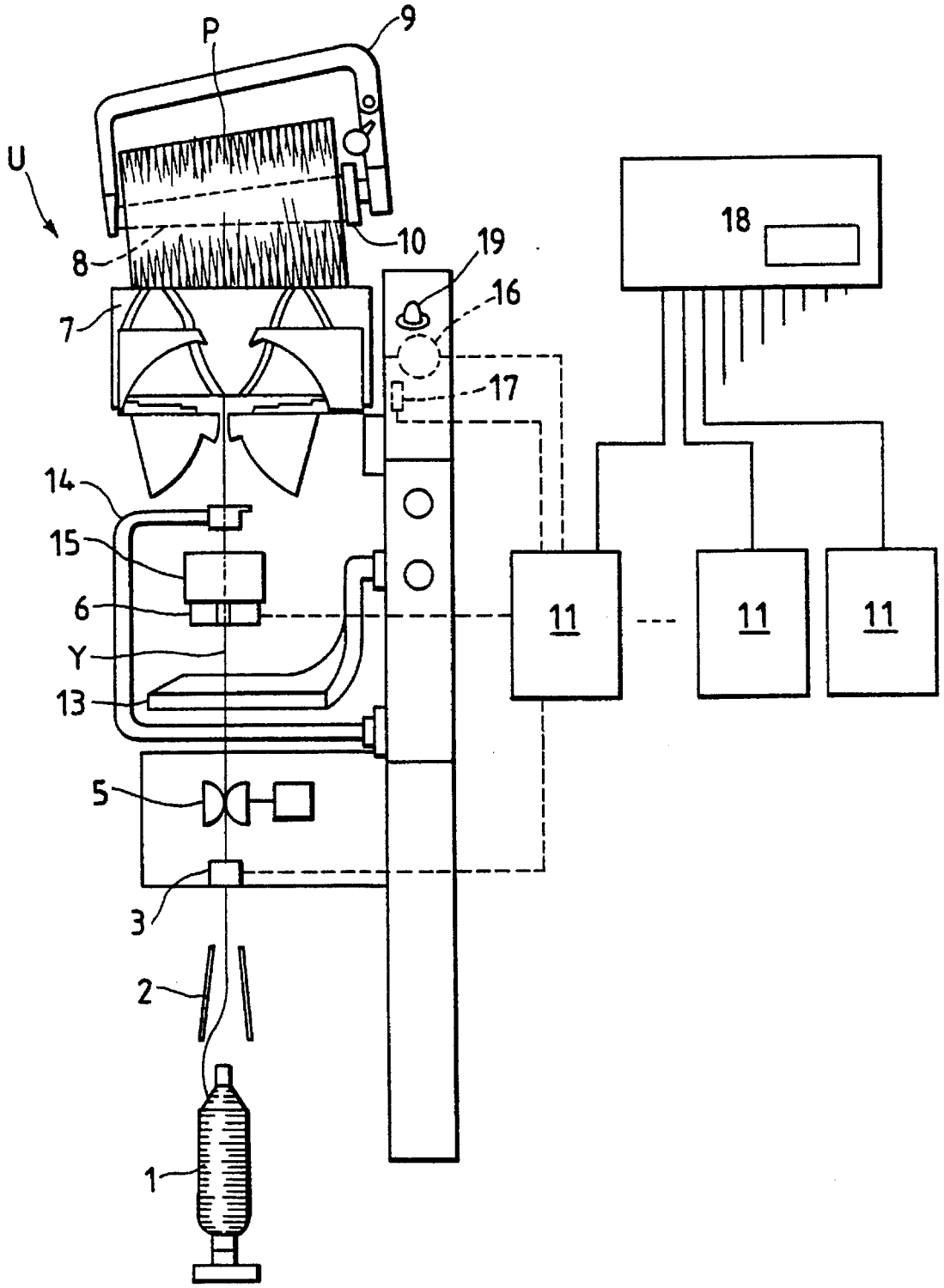
FIG. 5 PRIOR ART
FIG. 5 is a schematic block diagram of the automatic winder.

A difference of the yarn tension control device from the device shown in FIG. 5 resides in the provision of an adjustable gate-type tensioning device 20 for all of the machine frames or for all of one group of the winding units U; an unwinding assisting device 35 for lowering the balloon control member (movable cylinder body), following the unwinding operation, in place of a fixed balloon breaker; and a yarn tension detecting device 30 at the yarn tensioning device of a specific winding unit U. Also, the control device 18 for controlling the winding unit U having a multitude of spindles is equipped with a feedback circuit 18*a* for specific spindles, and a reference value output circuit 18*b* for other multitude of spindles. The unit controller 11 for specific spindles is provided with an output circuit 11*a* correspondingly to the tensioning device 20, an output circuit 11*b* correspondingly to the yarn tension detecting device 30, and a ratio output circuit 11*c* correspondingly to the output circuit 11*a*. The unit controller 11 for others than the specific spindles differs also in that it is fitted with the output circuit 11*a* correspondingly to the tensioning device 20 and the ratio output circuit 11*c* correspondingly to the output circuit 11*a*. Other differences are similar to those shown in FIG. 5, wherein the same reference numerals are used to omit its explanation.

Hereinafter explained is the control of tension pattern by the above-described control device 18 and the unit controller 11. In a specific spindle, when a preset period of time has passed to a stability time, the output circuit 11*b* of the yarn tension detecting device 30 outputs a signal corresponding to an actual tension value to the feedback circuit 18*a*, through which the yarn tension is controlled to a desired tension, and then the reference voltage (corresponding to the torque) T2 is outputted to the tensioning device 20 through the output circuit 11*a*. The feedback circuit 18*a* is not constantly operating as described above, but operates only during a specific period of winding for package formation, feeding back the actual tension value of the specific spindle and the set tension value to thereby adjust the reference voltage at which a desired tension is obtainable.

Next, the reference value output circuit 18*b* outputs the reference voltage in relation with the set tension value thus fed back, to the output circuit 11*a* of other spindles than the specific spindles, and other multitude of spindles operate the tensioning device similarly to the specific spindles. The ratio output circuit 11*c* provided at the unit controller 11 of each spindle serves to change the tension value corresponding to the take-up condition of each spindle by use of the ratios R1 and R2 in relation to the reference voltage. For example, it is desirable to start winding on an empty take-up tube with a high tension at the beginning of drum rotation, or within a specific period of time from the start of the package rotation after yarn joining; therefore the tensioning device is operated, using the ratio R1 which is a constant of 1 or greater, at the reference voltage T2×ratio R1=increased voltage T1. Since the unwinding tension gradually increases after the bobbin has been unwound 70 percent, the yarn tension should be so set as to gradually decrease according to the length of the yarn for the purpose of offsetting the increased unwinding tension. In this case, therefore, the tensioning device is to be operated, using the ratio R2 which is a constant of 1 or less, in such a manner that the voltage will be gradually decreased to the reference voltage T2×ratio R2=decreased voltage T3.

Figures 3, 3A:
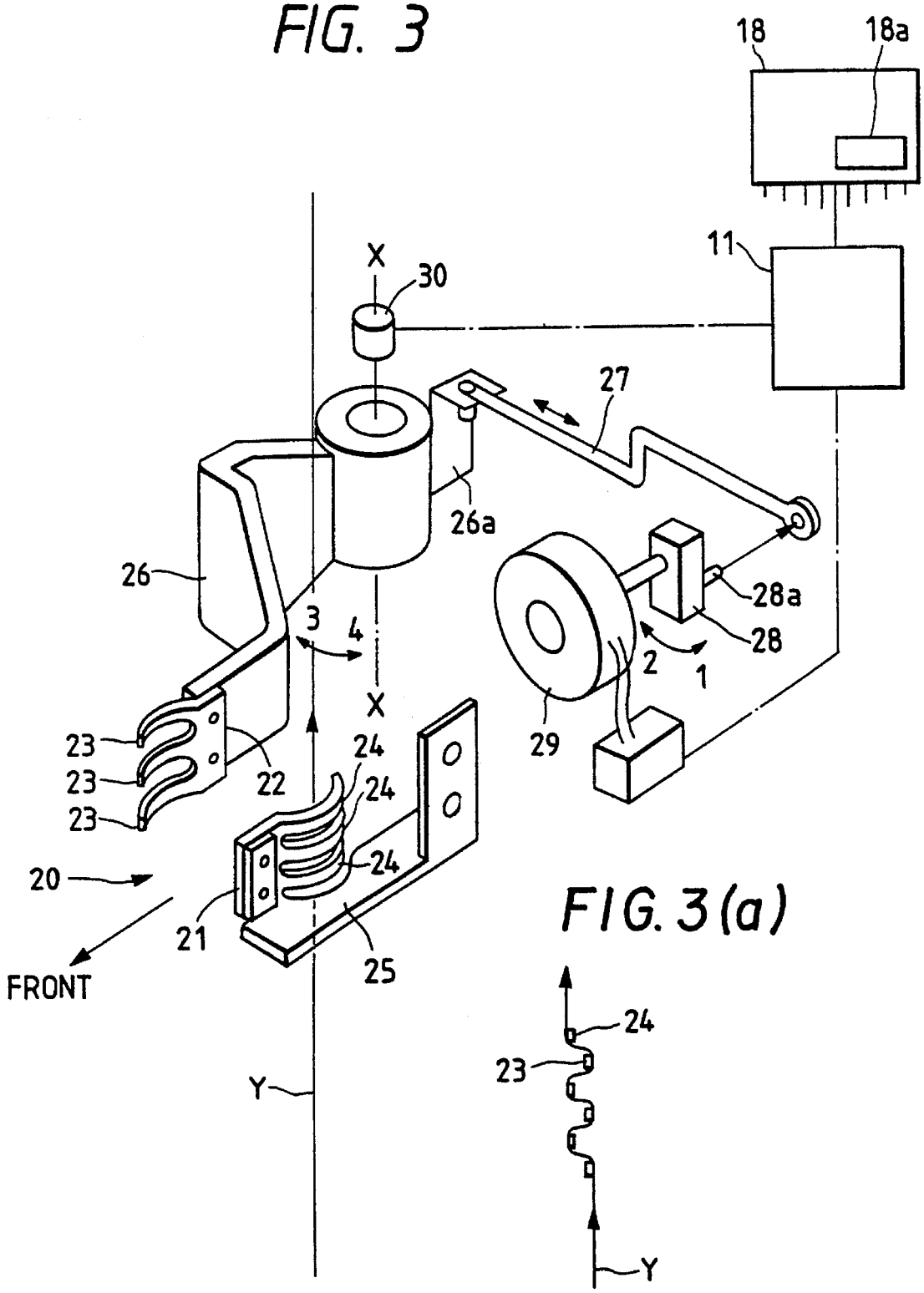
FIG. 3 is a perspective view of the tensioning device and a tension detecting device.

Next, the gate-type tensioning device 20 and the tension detecting device 30 attached thereto will be explained on the basis of FIGS. 3 and 4. In FIG. 3, the tensioning device 20 has a pair of first comb-shaped part 21 and second comb-shaped part 22 which can be engaged with each other. Either of the comb-shaped parts 21 and 22 has three teeth 23 or 24 which are equally spaced, protruding sidewards, so that these combs may be engaged with each other. The first comb-shaped part 21 is secured by bolts to a bracket 25, which is secured on the side face of a tenser box not illustrated. The second comb-shaped part 22 is also secured by bolts to a rocking lever 26 (or bracket 26) and is rotatable around the axis X—X. To an arm 26*a* provided on the opposite side of the rocking lever 26 is attached a connecting rod 27, the forward end of which is inserted on an eccentric shaft 28*a* of an eccentric lever 28. The eccentric lever 28 is connected to a rotary-type solenoid 29. This solenoid 29 is designed to operate a moving iron by utilizing magnetic attraction obtained by supplying the current to the coil, thereby outputting a turning torque correspondingly to the voltage applied.

The combs 23 and 24 are curved in a crescent form in the tooth part for the purpose of holding the yarn Y in the yarn path. The teeth of the movable comb 23 are inserted for engagement with those of the secured comb 24 as shown in FIG. 3(*a*). When these combs are in engagement, the yarn Y, therefore, is bent zigzag. The degree of engagement of these comb 23 and 24 depends upon the rocking torque of the rocking lever 26 produced from the solenoid 29, being easily adjustable by controlling the voltage to be applied to the solenoid 29.

At the start of winding or in case of yarn breakage, the solenoid 29 turns the eccentric lever 28 in the direction ①, actuating the rocking lever 26 in the direction ③ through the connecting rod 27 to open the comb-shaped parts 21 and 22. In this state, the yarn is passed or joined. After the yarn is passed, the solenoid 29 rotates the eccentric lever 28 in the direction ②, to thereby rock the rocking lever 26 in the direction ④ through the connecting rod 27, thus closing the comb-shaped parts 21 and 22 into engagement with each other as shown in FIG. 3(*a*). In this state the yarn is bent zigzag, and adding a yarn tension according to the degree of bend. When the running yarn has a thick part, temporarily increasing the yarn tension, while the rotation torque of the solenoid is fixed, the degree of engagement of the combs 23 and 24 decreases, thus lessening the yarn tension. Reversely, if the running yarn has a thin part, temporarily decreasing the yarn tension, while the rotation torque of the solenoid is fixed, the degree of engagement of the combs 23 and 24 increases in accordance with an increase in the yarn tension, increasing the yarn tension. The gate-type tensioning device 20, as described above, has a good response, functioning to compensate for peak increase and decrease of the yarn tension.

The tensioning device described above is provided for every spindle and is operated by means of the unit controller 11. Then, the control device 18 outputs set values which are specific tension patterns described later, to all machine frames for forming the same type of package or the unit controller 11 of one group of winding units. The solenoid 29 adjusts the amount of engagement of the combs 23 and 24 through the unit controller 11 to adjust the yarn tension, thereby presenting a specific tension pattern.

Figure 4A:
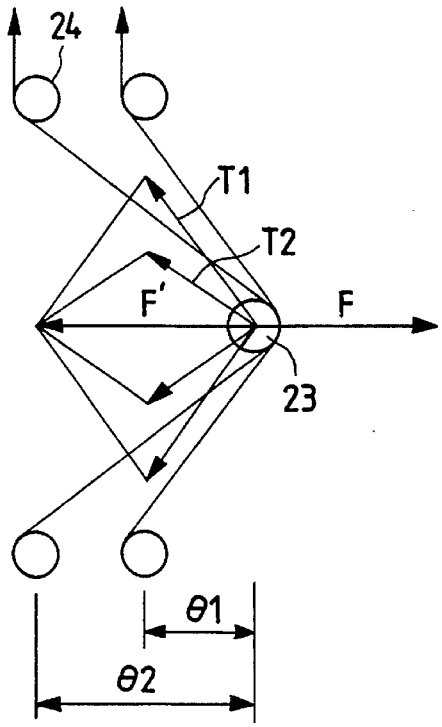
FIGS. 4*a* and 4*b* show the manner in which the tension detecting device operates.
Figure 4B:
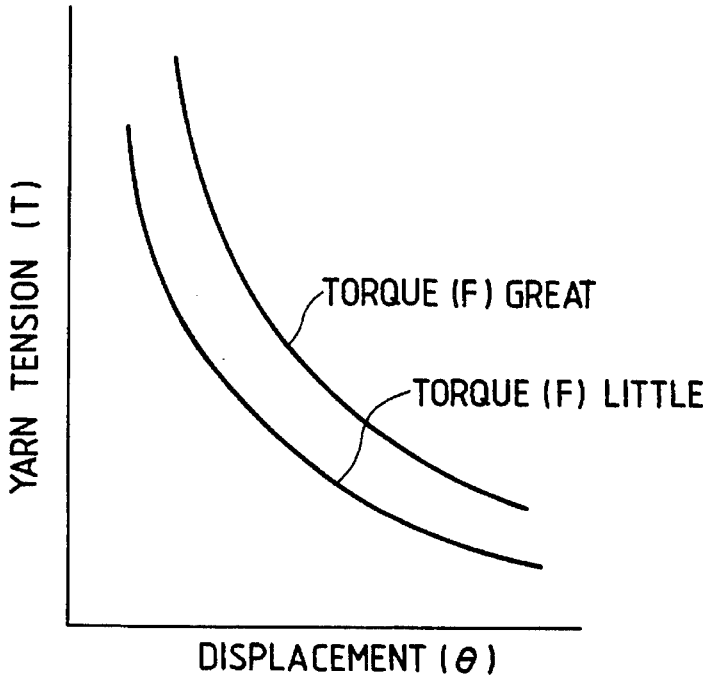

Furthermore, the tension detecting device 30 is installed for all machine frames for forming the same type of package or a specific winding unit (a representative spindle) of one group of winding units. This tension detecting device 30 is constituted of an angle sensor which detects the angle of rotation of the axis X—X of the lever 26 (or bracket 26). The principle of yarn detection by this angle sensor will be explained by referring to FIGS. 4*a* and 4*b*. As shown in FIG. 4(*a*), the movable comb 23 engaged with the fixed comb 24 is supplied with a force F which is determined by the turning torque of the solenoid. Against this force F is a resultant force F' of tension of the yarn Y. If the tension T1 of the yarn Y is great, the displacement between the combs 23 and 24 (corresponding to the angle of rotation of the bracket 26 in FIG. 3) decreases to θ1 for balancing. Reversely, if the tension T2 of the yarn Y is little, the displacement between the combs 23 and 4 increases to θ2 for balancing. Accordingly, as shown in FIG. 4(*b*), the displacement θ and the yarn tension T has a specific relationship with a known torque F. Therefore, there is predetermined by experiments a relational expression of the yarn tension T, the displacement θ and the torque F; and using this relational expression the yarn tension T is calculated out from the yarn tension T, the displacement θ and the torque F. This relational expression has been incorporated in the program entered in the control device 18 of FIG. 3. Then, the actual tension pattern of the specific spindle is outputted by the printer of the control device 18, and is compared with the tension pattern previously set by the control device 18, thereby enabling the correction of the set values of the control device 18 which produces a command of tension pattern to a multitude of winding units. This correction of set values can automatically be adjusted.

The above-described gate-type tensioning device is desirable as an adjustable tensioning device 20; in this case, a disc-type tensioning device may be used in which the yarn is passed between two discs pressed with a pressure against each other and the pressure is variably controllable. The yarn tension detecting device 30 is preferably built in the tensioning device 20, but if there exists an excess space in the yarn path of the winding unit, a unit-type tension sensor having a movable rod placed between two fixed rods may be separately installed so as to measure the yarn tension by utilizing a pressure of the running yarn acting on the movable rod.

Furthermore, the unwinding assisting device 35 of FIG. 1 will be explained. This unwinding assisting device 35 properly restricts ballooning of the yarn being unwound from the bobbin 1 in order to suppress the change and increase of the unwinding tension, and is preferably used together to narrow the range of adjustment of the above-described tensioning device 20. The unwinding assisting device 35 shown in the drawing consists of a fixed cylinder 36, a throttle 37 in the fixed cylinder 36, a movable cylinder 38 inserted over the fixed cylinder 36, a lifting device 39 vertically movably supporting the movable cylinder 38, and a sensor 40 mounted at the lifting device 39 for detecting the chess section 1*a*.

With the progress of unwinding of the bobbin 1, the spacing between the sensor 40 and the chess section 1*a* becomes wider, so that the unit controller 11 inputted with a signal from the sensor 40 will actuate the lifting device 39 to lower the movable cylinder 38, thus maintaining a nearly fixed spacing between the movable cylinder 38 and the chess section 1*a* and further keeping a proper unwinding angle of the yarn which tends to balloon after being unwound from the chess section 1*a*. Also, the fixed cylinder 36 and its throttle 37 serve to suppress balloon variation of the yarn reaching the feeler 3. The variation and increase of the unwinding tension can be lessened by thus properly maintaining the shape of the balloon. However, the lower limit of this unwinding assisting device 35 has been set in the vicinity of a 30-percent wound bobbin (about 30 percent of yarn remaining on the bobbin) where the unwinding of the yarn from the chess section 1*a* tends to be disturbed. The location of this 30-percent wound bobbin can be detected by an electronic scale or other mounted at the lifting device 39.

Next, an example of setting of a proper tension pattern using the above-described tensioning device 20 and the unwinding assisting device 35 will be explained by referring to FIG. 2. In FIG. 2, at the time t1 the doffing has been completed, an empty take-up tube 8 has been mounted on the cradle 9 in FIG. 1, and the friction roller 10 is in contact with the drum 7. In this state the yarn wound on the take-up tube 8 is not in contact with the drum 7, and therefore, a slightly high yarn tension T1 is used until a 2 to 3 mm thick yarn layer is formed, and at the time t2 the yarn tension is changed back to the specific yarn tension T2. Also, when a yarn defect is removed and yarn joining is effected at the time t3, the yarn tension is changed to the slightly high yarn tension T1 to prevent slough-off during a period until the rise time (for example for several seconds). At the time t4, the tension is changed back to the specific yarn tension T2. When the remaining amount of yarn on the bobbin becomes about 30 percent, the unwinding assisting device 35 shown in FIG. 1 decreases in its effect, allowing a gradual increase in the unwinding tension. To offset this increase in the winding tension after the 30-percent wound bobbin, it is necessary to gradually decrease the tension T2 to T3 during the period from the time t5 to the time t6 when the bobbin becomes empty. The timing to find this 30-percent wound bobbin can be detected by the unit controller 11 which controls the lifting device 39 of the unwinding assisting device 35 in FIG. 1. Then, during the period from the time t6 to the time t7 bobbin change for changing the empty bobbin to a new one is performed; and unwinding is restarted with a slightly higher yarn tension T1 so that the yarn layer will not slough off, and then the yarn tension is set back to the specific yarn tension T2 at the time t8. As described above the yarns of several to several tens of bobbins, after bobbin change, will be joined, thus producing a specific full package by the time tx. The effect of this tension pattern differs with the type of yarn; it is possible to set a proper tension pattern by detecting an actual yarn tension of a specific spindle chosen as a sample.

Furthermore, it is possible to additionally increase and decrease the winding speed by other than the above-described tension pattern. For example, during the initial period of package winding from the time t1 to the time t2, the winding speed is set lower than the specific value in order to prevent the yarn layer on the package from sloughing off. Also, when the unwinding tension tends to increase during the period from the time t5 to the time t6 although the yarn tension is gradually decreased, it is possible to gradually decrease the winding speed also.

In the embodiment mentioned above, the specific unit is illustrated as to be a single unit. However, for example, plural units more than two units may be set to be the specific units which act for all units. In that case, the operation data which are obtained from a plurality of specific units are averaged and the operation condition of units other than the specific units may be possibly controlled based on the averaged data.

The yarn tension control device of the automatic winder according to the present invention functions to control the tensioning device of a multitude of spindles other than a specific spindle with reference to an output value to the tensioning device at the specific spindle to be feedback-controlled by for example the yarn tension detecting device, presenting the optimum tension pattern to a plurality of spindles for producing the same type of packages without using the yarn tension detecting device at every spindle and accordingly enabling high-speed winding while suppressing an increase in the yarn tension at the end of winding and decreasing yarn breakage at the end of winding.

Figure 6:
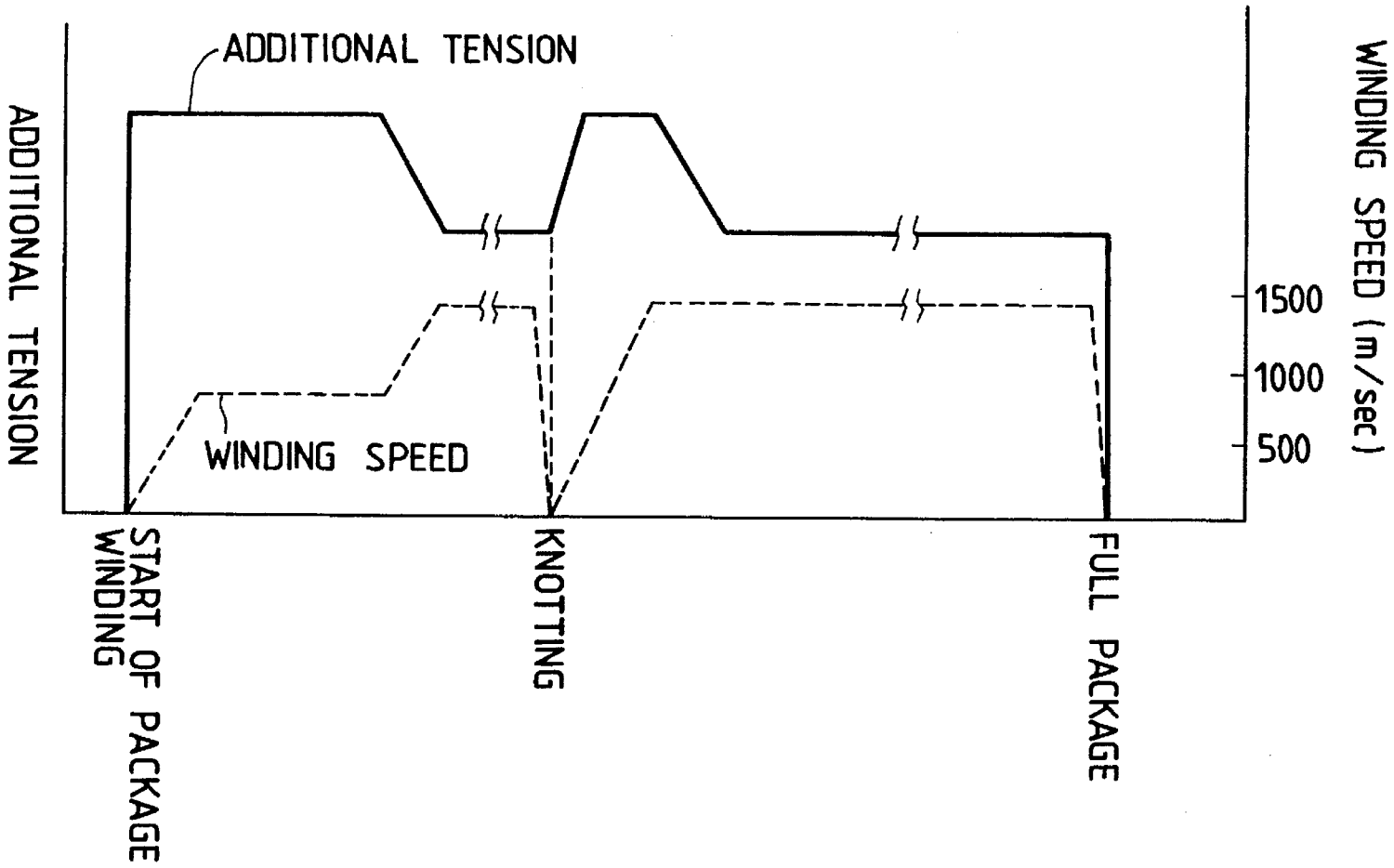
FIG. 6 is a view showing a tension map concerning the winding speed and additional tension during winding that have been stored in the control device.

If it is intended to wind the package at a high speed from the start in an attempt to set the winding speed to a high speed, there will sometimes occur slough-off; in this case, the slough-off can effectively be prevented by adding high tension to the yarn at the start of package winding. However, if the additional tension is set too high, the yarn breakage will take place frequently owing to an increased releasing tension at the end of winding of the yarn supply bobbin. Contrarily, winding can be performed without slough-off by setting a high additional tension value at the beginning of winding of the package and also by setting the winding speed lower than that for the package of normal size. Shown in FIG. 6 is this winding speed and tension control.

Described in the above-described embodiment is an example of controlling the tension to be stored in the control device 11 and the voltage value of the solenoid with the package in a wound state and with the bobbin in an unwound state. For the voltage values corresponding to the tension T1, T2 and T3 various maps may be stored in accordance with the package winding speed. For example, the yarn tension may be changed in accordance with the winding speed; the voltage value may be set to various values; and the rise and fall gradients may be arbitrarily set.

While the invention has been particularly shown and described in reference to preferred embodiments thereof, it will be understood by those skilled in the art that changes in form and details may be made therein without departing from the spirit and scope of the invention.

What is claimed is:

1. A winding operation control method for an automatic winder having an automatic winder with a large number of winding units arranged in rows, comprising the steps of:

setting at least a unit to be a specific unit which acts for at least some of said winding units;

storing an operation data of said specific unit; and controlling an operation of said at least some of said winding units other than the specific unit based on the operation data of the specific unit, wherein said specific unit and said at least some of said winding units other than the specific unit operate independently, and wherein said operation data stored for said specific unit is provided to said units other than the specific unit for controlling thereof.

2. A winding operation control apparatus of an automatic winder, comprising:

an automatic winder having a plurality of winding units arranged in rows, wherein at least one winding unit is set to be a specific unit which acts for at least some of said winding units;

a storage means for storing therein winding operation data for said specific unit;

a first control device which controls an operation condition of said specific unit; and a second control device which controls an operation condition of said at least some of said winding units other than the specific unit based on the winding operation data stored for said specific unit, wherein said first control device controls said operation of said specific unit independent from said second control device controlling said at least some of said winding units other than said specific unit.

3. A winding operation control apparatus of an automatic winder, comprising:

a tensioning device variably controlled by each of a plurality of spindles of a winding unit;

a yarn tension detecting device for a specific one of said plurality of spindles, said yarn tension detecting device controlling said tensioning device for said specific spindle;

storing means for storing therein data, including data for said tensioning device, for said specific one of said plurality of spindles; and a control device for controlling said tensioning devices for other ones of said plurality of spindles, which are other than said specific spindle, on the basis of an output value for said tensioning device of said specific spindle, wherein said yarn tension detecting device controls said tensioning device of said specific spindle independent from the control of said tensioning devices of said other ones of said plurality of spindles.

4. A winding operation control apparatus as claimed in claim 3, wherein a unit controller is provided in said winding unit, wherein said control device sets a winding condition of said unit controller and stores tension from said storing means data, and wherein said tensioning device adjusts tension corresponding to said tension data, said tension data being stored so as to be changed stepwise from the start of a winding of a package to an end of the winding thereof.

5. A winding operation control apparatus as claimed in claim 3, wherein a unit controller is provided with said winding unit, wherein the control device, which sets winding condition in said unit controller, stores a yarn tension data from said storing means, wherein said yarn tensioning device of said plurality of spindles adjusts tension corresponding to said yarn tension data, and wherein said control device also stores yarn tension data used for increasing tension at the start of package winding.

6. A winding operation control apparatus of an automatic winder as claimed in claim 5, wherein said control device stores yarn tension data used for increasing yarn tension during a period of time until a winding operation reaches to a normal condition after a yarn joining operation.

7. A winding operation control apparatus of an automatic winder as claimed in claim 3, wherein a unit controller is provided with said winding unit, wherein the control device, which sets winding conditions in said unit controller, stores a yarn tension data, wherein said yarn tensioning device of said plurality of spindles adjusts tension corresponding to said yarn tension data, and wherein said control device also stores yarn tension data used for decreasing tension when an unwinding resistance increases owing to little remainder of yarn on a spinning bobbin.

8. A winding operation control apparatus of an automatic winder as claimed in claim 7, further comprising an unwinding assisting device, vertically movable above a spindle, for restricting ballooning of a yarn being unwound from a bobbin and for suppressing change and increase of an unwinding tension, wherein the unit controller detects the time when an unwinding resistance increases, said unit controller controlling the lifting of said assisting device.

9. A winding operation control apparatus of an automatic winder as claimed in claim 3, wherein said control device includes a feedback circuit for said specific spindle and a reference value output circuit for other multitude of spindles, a unit controller for specific spindles includes a first output circuit correspondingly to the tensioning devices for said other multitude of spindles, a second output circuit correspondingly to the yarn tension detecting device and a ratio output circuit correspondingly to the first output circuit, and said unit controller for others than the specific spindles is provided with the first output circuit correspondingly to the tensioning device and the ratio output circuit correspondingly to the first output circuit.

10. A winding operation control apparatus of an automatic winder as claimed in claim 9, wherein said ratio output circuit provided in the unit controller serves to change a tension value corresponding to a take-up condition of each spindle by use of ratios in relation to a reference voltage.

* * * * *